US010916374B2

(12) United States Patent
Tanaka

(10) Patent No.: US 10,916,374 B2
(45) Date of Patent: Feb. 9, 2021

(54) MANUFACTURING METHOD OF COIL COMPONENT AND MANUFACTURING APPARATUS OF COIL COMPONENT

(71) Applicant: SUMIDA CORPORATION, Tokyo (JP)

(72) Inventor: Teruaki Tanaka, Natori (JP)

(73) Assignee: SUMIDA CORPORATION

( * ) Notice: Subject to any disclaimer, the term of this patent is extended or adjusted under 35 U.S.C. 154(b) by 496 days.

(21) Appl. No.: 15/862,925

(22) Filed: Jan. 5, 2018

(65) Prior Publication Data

US 2018/0233282 A1 Aug. 16, 2018

(30) Foreign Application Priority Data

Feb. 15, 2017 (JP) ..... 2017-025959

(51) Int. Cl.
*H01F 3/08* (2006.01)
*H01F 7/06* (2006.01)
(Continued)

(52) U.S. Cl.
CPC ..... *H01F 41/076* (2016.01); *H01F 1/15308* (2013.01); *H01F 17/045* (2013.01);
(Continued)

(58) Field of Classification Search
CPC .. H01F 1/15308; H01F 17/045; H01F 41/005; H01F 41/0246; H01F 41/076;
(Continued)

(56) References Cited

U.S. PATENT DOCUMENTS 5,672,363 A 9/1997 Sagawa et al.
6,617,948 B2 * 9/2003 Kuroshima ..... H01F 17/043 29/602.1
(Continued)

FOREIGN PATENT DOCUMENTS

CN 102810392 A 12/2012
CN 103151139 A 6/2013
(Continued)

OTHER PUBLICATIONS

Extended European Search Report for EP Application No. 18156114.3, dated Jul. 26, 2018 (10 pages).
(Continued)

*Primary Examiner* — Paul D Kim
(74) *Attorney, Agent, or Firm* — Harness, Dickey & Pierce, P.L.C.

(57) ABSTRACT

A manufacturing method of a coil component for forming a coil-assembly body in which a coil is mounted on a magnetic-body core, comprising the steps of: inputting the coil-assembly body and an admixture containing a magnetic powder and a resin into a container; applying pressure onto the admixture which is inputted into the container; depressurizing an air pressure of an environment, in which the admixture is placed, to become a negative-pressure lower than the atmospheric pressure at least during the pressurizing process in the step of applying pressure; applying vibration onto the admixture and filling the admixture in the container at least during the depressurizing process in the step of depressurizing; and curing the resin contained in the admixture for the integrated object of the admixture and the coil-assembly body which passed through the step of depressurizing and the step of applying vibration.

9 Claims, 7 Drawing Sheets

(51) Int. Cl.

| | |
|---|---|
| ***H01F 41/076*** | (2016.01) |
| ***H01F 27/29*** | (2006.01) |
| ***H01F 27/02*** | (2006.01) |
| ***H01F 1/153*** | (2006.01) |
| ***H01F 41/02*** | (2006.01) |
| ***H01F 17/04*** | (2006.01) |
| ***H01F 27/06*** | (2006.01) |
| ***H01F 41/00*** | (2006.01) |

(52) U.S. Cl.
CPC ..... *H01F 27/02* (2013.01); *H01F 27/06* (2013.01); *H01F 27/29* (2013.01); *H01F 41/005* (2013.01); *H01F 41/0246* (2013.01); *H01F 2017/048* (2013.01)

(58) Field of Classification Search
CPC ..... H01F 27/02; H01F 27/06; H01F 27/29; H01F 2017/048
See application file for complete search history.

(56) References Cited

U.S. PATENT DOCUMENTS

| | | | | |
|---|---|---|---|---|
| 7,327,212 | B2 * | 2/2008 | Sano | H01F 27/027 336/192 |
| 7,523,542 | B2 * | 4/2009 | Kawarai | H01F 17/043 29/602.1 |
| 9,087,634 | B2 | 7/2015 | Sakamoto et al. | |
| 9,576,721 | B2 | 2/2017 | Sakamoto et al. | |
| 10,032,558 | B2 * | 7/2018 | Oki | H01F 41/04 |
| 2002/0189714 | A1 | 12/2002 | Mitani et al. | |
| 2004/0046626 | A1 * | 3/2004 | Nakata | H01F 17/043 336/83 |
| 2008/0035879 | A1 | 2/2008 | Matsukawa et al. | |
| 2008/0036566 | A1 | 2/2008 | Klesyk et al. | |
| 2010/0134233 | A1 * | 6/2010 | Wang | H01F 17/045 336/192 |
| 2013/0309122 | A1 | 11/2013 | Mochizuki et al. | |
| 2016/0075058 | A1 | 3/2016 | Takahashi et al. | |
| 2016/0247626 | A1 | 8/2016 | Kawarai et al. | |
| 2017/0034915 | A1 | 2/2017 | Uchikoba et al. | |
| 2017/0053739 | A1 | 2/2017 | Oki et al. | |

FOREIGN PATENT DOCUMENTS

| | | | |
|---|---|---|---|
| CN | 104269262 | A | 1/2015 |
| EP | 2996124 | A1 | 3/2016 |
| JP | S60-97610 | A | 5/1985 |
| JP | 2011-003761 | A | 1/2011 |
| JP | 2013-004657 | A | 1/2013 |
| WO | WO-2005-096325 | A1 | 10/2005 |
| WO | WO-2012-105399 | A1 | 8/2012 |

OTHER PUBLICATIONS

Japanese Notice of Reasons for Refusal for Patent Application No. JP 2017-025959 dated Sep. 10, 2020 (6 pages with translation).

* cited by examiner

MANUFACTURING METHOD OF COIL COMPONENT AND MANUFACTURING APPARATUS OF COIL COMPONENT

CROSS REFERENCES TO RELATED APPLICATION

The present invention contains subject matter related to Japanese Patent Application 2017-025959, filed in the Japanese Patent Office on Feb. 15, 2017, the entire contents of which being incorporated herein by reference.

BACKGROUND OF THE INVENTION

Field of the Invention

The present invention relates to a manufacturing method of a coil component and a manufacturing apparatus of a coil component.

Description of the Related Art

There have been proposed various kinds of coil components each of which includes a magnetic core and a winding-wire coil. Among such coil components, there exists a component in which a coil formed by winding a rectangular wire or the like is attaching onto a magnetic-body core formed by a magnetic-body and in which there is further provided a magnetic cover portion which covers those members (see Chinese unexamined patent publication No. 103151139). This magnetic cover portion is formed by filling the inside of a mold with an admixture which is obtained by mixing metal-made magnetic powders and a resin by using an injection molding technique in a molten state, and then, by employing a mold-forming using a magnetic material.

SUMMARY OF THE INVENTION

Meanwhile, it is required for the constitution as mentioned above that filling defect of the admixture would not occur at the periphery or the like of the coil on an occasion of mass-producing the coil components. For that reason, it is conceivable to pressurize the admixture. However, the admixture mentioned above has a comparatively high viscosity and even if the admixture thereof is pressurized, there may be a space which is not sufficiently filled with the admixture (filling defect) in the mold. The filling defect of the admixture becomes one reason of a fluctuation which occurs in the quality of the coil component.

The present invention was invented in view of such a problem and is addressed to provide a manufacturing method of a coil component and a manufacturing apparatus of a coil component in which it is possible to decrease the filling defect of the admixture.

The manufacturing method of a coil component according to one embodiment of the present invention is characterized by a manufacturing method of a coil component for forming a coil-assembly body in which a coil is mounted on a magnetic-body core, including the steps of: inputting the coil-assembly body and an admixture containing a magnetic powder and a resin into a container; applying pressure onto the admixture which is inputted into the container; depressurizing an air pressure of an environment, in which the admixture is placed, to become a negative-pressure lower than the atmospheric pressure at least during the pressurizing process in the step of applying pressure; applying vibration onto the admixture and filling the admixture in the container at least during the depressurizing process in the step of depressurizing; and curing the resin contained in the admixture for the integrated object of the admixture and the coil-assembly body which passed through the step of depressurizing and the step of applying vibration.

The manufacturing apparatus of a coil component according to one embodiment of the present invention is characterized by a manufacturing apparatus of a coil component for forming a coil-assembly body in which a coil is mounted on a magnetic-body core, including: a container housing the coil-assembly body and an admixture containing a magnetic powder and a resin; a press member applying pressure to the admixture inside the container; a vibration generating mechanism which applies vibration to the admixture inside the container and which fills the admixture in the container; and a depressurizing mechanism depressurizing the environment, in which the admixture is placed, to become a negative-pressure environment lower than the atmospheric pressure at least during the application of the vibration by the vibration generating mechanism.

According to the present invention, it becomes possible to provide a manufacturing method of a coil component and a manufacturing apparatus of a coil component, in which it is possible to decrease the filling defect of the admixture.

DESCRIPTION OF THE PREFERRED EMBODIMENTS

First Exemplified Embodiment

Hereinafter, there will be explained a manufacturing method and a manufacturing apparatus of a coil component 10 of a first exemplified embodiment of the present invention. In the following explanation, there will be used the XYZ orthogonal coordinate system if it is necessary. In the XYZ orthogonal coordinate system, "X direction" indicates a direction toward which terminals 43*a*, 43*b* are aligned in line in FIG. 1 in which "X1 side" indicates the right front in FIG. 1 and "X2 side" indicates the left rear side which is opposite thereto. In addition, "Y direction" indicates a direction toward which the terminals 43*a*, 43*b* stretch on the lower bottom surface 31C in which "Y1 side" indicates the right rear side in FIG. 1 and "Y2 side" indicates the left front side which is opposite thereto. In addition, "Z direction" indicates the axis direction of a pillar-shaped core portion 32 in which "Z1 side" indicates the upper side thereof and "Z2 side" indicates the lower side thereof.

Coil Component

First, prior to the explanation of the manufacturing method and the manufacturing apparatus of the coil component 10 of the first exemplified embodiment, there will be explained the coil component 10 which is manufactured by the manufacturing method and the manufacturing apparatus of the first exemplified embodiment.

Figure 1:
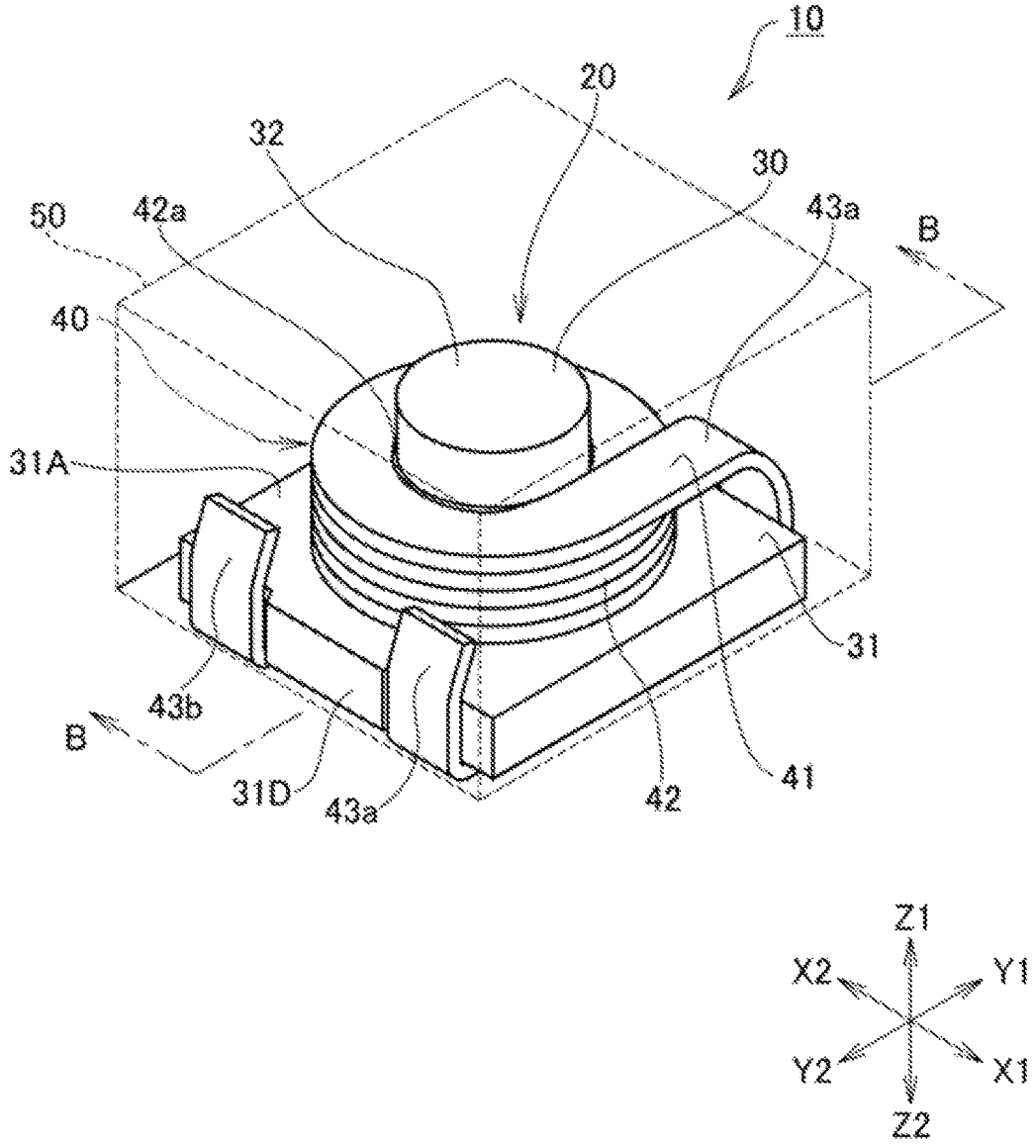
FIG. 1 is a perspective view transparently showing an internal constitution of a coil component relating to a first exemplified embodiment of the present invention.
Figure 2:
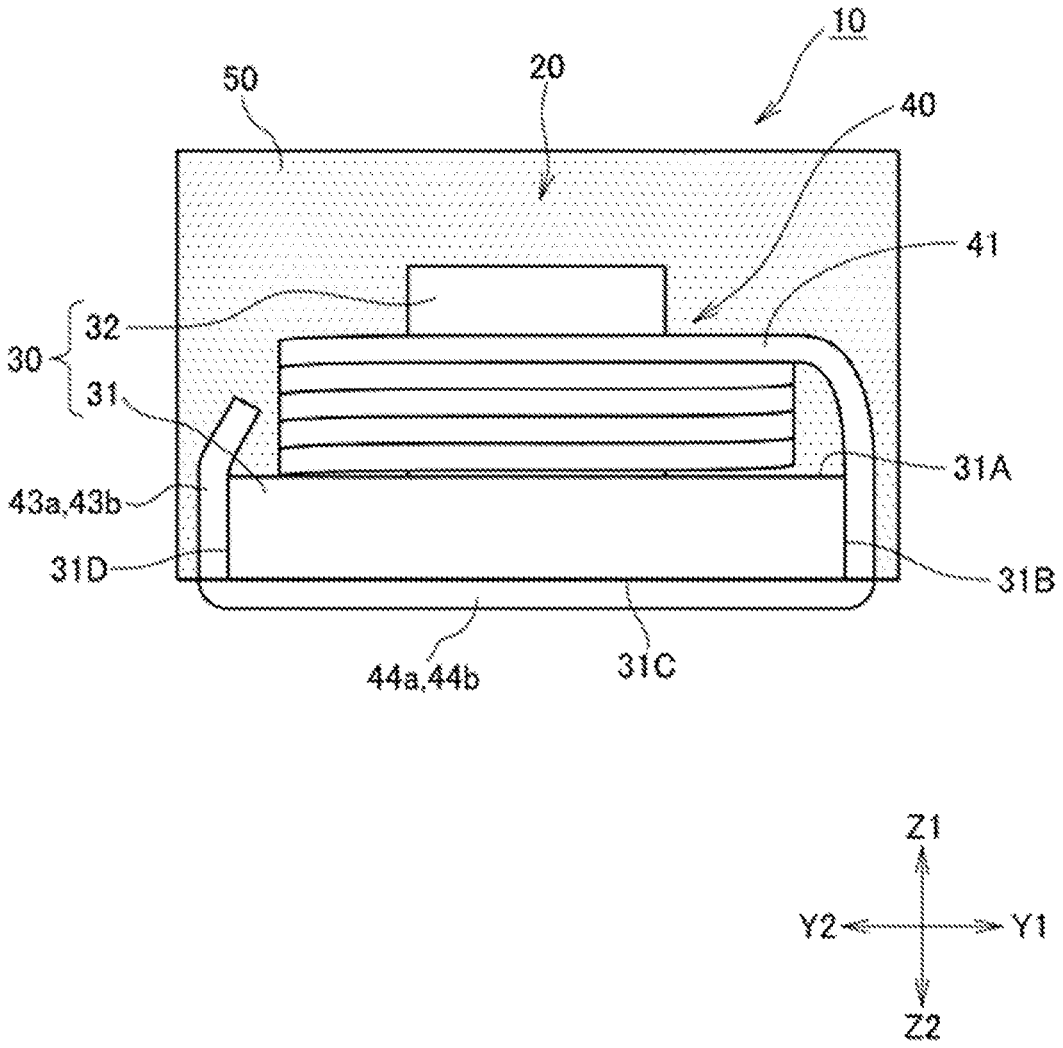
FIG. 2 is a cross-sectional view along an arrow B-B shown in FIG. 1.

FIG. 1 is a perspective view transparently showing an internal constitution of a coil component 10 relating to a first exemplified embodiment of the present invention. FIG. 2 is a cross-sectional view along an arrow B-B shown in FIG. 1. In FIG. 2, there is shown a cross-section of only the magnetic cover portion 50. And a coil-assembly body 20 is shown by a side view thereof.

The coil component 10 in the first exemplified embodiment constitutes an electronic component such as an inductor, a transformer, a choke coil or the like. The coil component 10 is formed by including the coil assembly body 20 and the magnetic cover portion 50 as main constituent elements. The coil assembly body 20 includes a magnetic-body core 30 and a coil 40.

The magnetic-body core 30 is provided with a flange portion 31 and a pillar-shaped core portion 32 integrally. The magnetic-body core 30 is formed by a material of a ferrite core which is obtained by sintering ferrite or of a dust core which is obtained by compression-molding magnetic powders. Here, for the magnetic powders of the dust core, it is possible to use magnetic powders whose main component is iron (Fe) and into which each of silicon (Si) and chromium (Cr) is added by a ratio of 1 wt % or more and 10 wt % or less. The magnetic powders are excellent in the aspects of rust-prevention property, relative permeability and the like. From the viewpoint of decreasing the core loss, it is allowed for the magnetic-body core 30 to be constituted by metal magnetic powders which are obtained by mixing the magnetic powders with an amorphous metal. For the amorphous metal, it is possible to use a carbon-contained amorphous metal whose main component is iron (Fe), in which each of silicon (Si) and chromium (Cr) is contained by a ratio of 1 wt % or more and 10 wt % or less, and further, in which carbon (C) is contained by a ratio of 0.1 wt % or more and 5 wt % or less. Further, in the first exemplified embodiment, it is also allowed for the magnetic-body core 30 to be formed so as to contain manganese (Mn) therein.

The flange portion 31 has a plate shape and according to the constitution shown in FIG. 1, the planar shape of the flange portion 31 forms approximately a square shape. However, the planar shape of the flange portion 31 is not to be limited to the "approximately square shape" and it is possible to employ various kinds of shapes such as a circle shape, an elliptical shape, a polygonal shape and the like. In addition, at the center portion of the flange portion 31, there is provided the pillar-shaped core portion 32 in a standing fashion. The pillar-shaped core portion 32 has a cylindrical shape stretching so as to be directed to the upward side (Z1 side), but it is allowed to employ a shape other than the cylindrical shape (to employ polygonal prism such as quadrangular prism or the like). The pillar-shaped core portion 32 is plugged into a coil hole 42*a* of the coil 40 which will be mentioned later.

In addition, for the coil 40, there is used a rectangular wire 41 (corresponding to conductive wire) whose width size is sufficiently larger than the thickness size thereof in which a winding wire portion 42 is formed by winding the rectangular wire 41 and the coil hole 42*a* is provided on the inner circumferential side of the winding wire portion 42. Into the coil hole 42*a*, the pillar-shaped core portion 32 mentioned above is plugged. It should be noted that according to the constitution shown in FIGS. 1 and 2, the winding wire portion 42 is formed by an edgewise winding in which the axis direction of that winding wire portion 42 is provided so as to be in conformity with the axis direction of the pillar-shaped core portion 32. In addition, it is allowed for the lower surface side of the winding wire portion 42 to be fixed with respect to the upper surface of the flange portion 31 by an adhesive agent. For such an adhesive agent, it is possible to use an insulating-resin adhesive agent.

One terminal 43*a* of the rectangular wire 41 extends from the upper surface side of the winding wire portion 42 toward a direction (Y1 side) in parallel with the upper surface 31A of the flange portion 31 of the magnetic-body core 30 and thereafter, abuts against a side surface 31B on the Y1 side within the flange portion 31 in FIG. 2 in parallel therewith and, further, is bent so as to be directed toward the Y2 side while being abutted against the lower bottom surface 31C of the flange portion 31. The portion abutted against the lower bottom surface 31C is exposed downward from the magnetic cover portion 50 and becomes a terminal unit 44*a* which will be electrically connected to another substrate or the like. Further, the terminal unit 44*a* is bent so as to be directed upward while being abutted against the side surface 31D on the Y2 side of the flange portion 31 and finally, is bent so as to be inclined toward the side of the pillar-shaped core portion 32 of the flange portion 31.

Similarly, the other terminal 43*b* of the rectangular wire 41 extends from the lower surface side of the winding wire portion 42 toward a direction (Y1 side) in parallel with the upper surface of the flange portion 31 and thereafter, abuts against a side surface 31B on the Y1 side within the flange portion 31 in FIG. 1 in parallel therewith and further, is bent so as to be directed toward the Y2 side while being abutted against the lower bottom surface 31C of the flange portion 31. It should be noted that the portion abutted against this lower bottom surface 31C is exposed downward from the magnetic cover portion 50 and becomes a terminal unit 44*b* which will be electrically connected to another substrate or the like. Such a portion becomes the terminal unit 44*b*, further, is bent so as to be directed upward while being abutted against the side surface 31D on the Y2 side of the flange portion 31 and finally, is bent so as to be inclined toward the pillar-shaped core portion 32 side of the flange portion 31.

It should be noted that it is also allowed to employ a configuration in which on the lower bottom surface 31C of the flange portion 31, there are provided groove portions (not shown) so as to sag upward for inducing the terminal units 44*a*, 44*b* to enter thereinto. Each of these groove portions has a shallower depth compared with the thickness of the rectangular wire 41 and each electrode groove houses a portion of the thickness of the terminal unit 44*a* (44*b*). For that reason, the downward sides of the terminal units 44*a*, 44*b* protrude downward from the lower bottom surface 31C. It is allowed for the upper surface sides of the terminal units 44*a*, 44*b* to be adhesively fixed onto the wall surfaces of the groove portions by using an adhesive agent.

The conductive wire can be a round wire having a circular cross-section shape instead of the rectangular wire 41 mentioned above. In that case, the terminal units 44*a*, 44*b* can be formed by being crushed in flat shapes.

In addition, on the side surface 31D on the Y2 side of the flange portion 31, there are formed side-surface concave portions (not shown) for positioning the terminals 43*a*, 43*b*.

For this reason, a portion or all of each thickness of the terminals 43*a*, 43*b* is housed in each of the side-surface concave portions and it can prevent the terminals 43*a*, 43*b* from protruding out of the side surface of the flange portion 31. In addition, the terminals 43*a*, 43*b* can be bonded to the wall surfaces of the side-surface concave portions.

Next, there will be explained the magnetic cover portion 50. The magnetic cover portion 50 is formed by a material containing magnetic powders and a thermosetting resin. For the magnetic powder, it can use a similar material as that of the magnetic-body core 30 mentioned above and it is also allowed to use a different material. In addition, for the resin, a resin which is to be cured under a specific condition is enough, for example any one of a thermosetting resin. That is, a two-component curing-type resin, or a light-curing resin which is cured by an irradiation of UV light or the like is fit for the purpose. When using a thermosetting resin as the resin, the thermosetting resin, for example, an epoxy resin, a phenol resin or a silicon resin can be used.

The magnetic cover portion 50 is provided so as to cover the coil assembly body 20 totally except the terminal units 44*a*, 44*b* mentioned above. It should be noted that it is allowed also for the lower bottom surface 31C of the flange portion 31 to be exposed. And it is also allowed for another portion other than the lower bottom surface 31C and the terminal units 44*a*, 44*b* within the coil assembly body 20 to be exposed. As shown in FIG. 1, the magnetic cover portion 50 is provided approximately in a rectangular shape. However, the shape of the magnetic cover portion 50 can be an arbitrary shape. And the shape thereof is not limited to the "approximately rectangular shape". The magnetic cover portion 50 is provided so as to cover the pillar-shaped core portion 32 of the magnetic-body core 30 and the winding wire portion 42 of the coil 40.

Manufacturing Apparatus of Coil Component

Next, there will be explained a constitution of a manufacturing apparatus of a coil component 100 (hereinafter, also described merely as "manufacturing apparatus" 100), which is used in order to manufacture the coil component 10.

Figure 3:
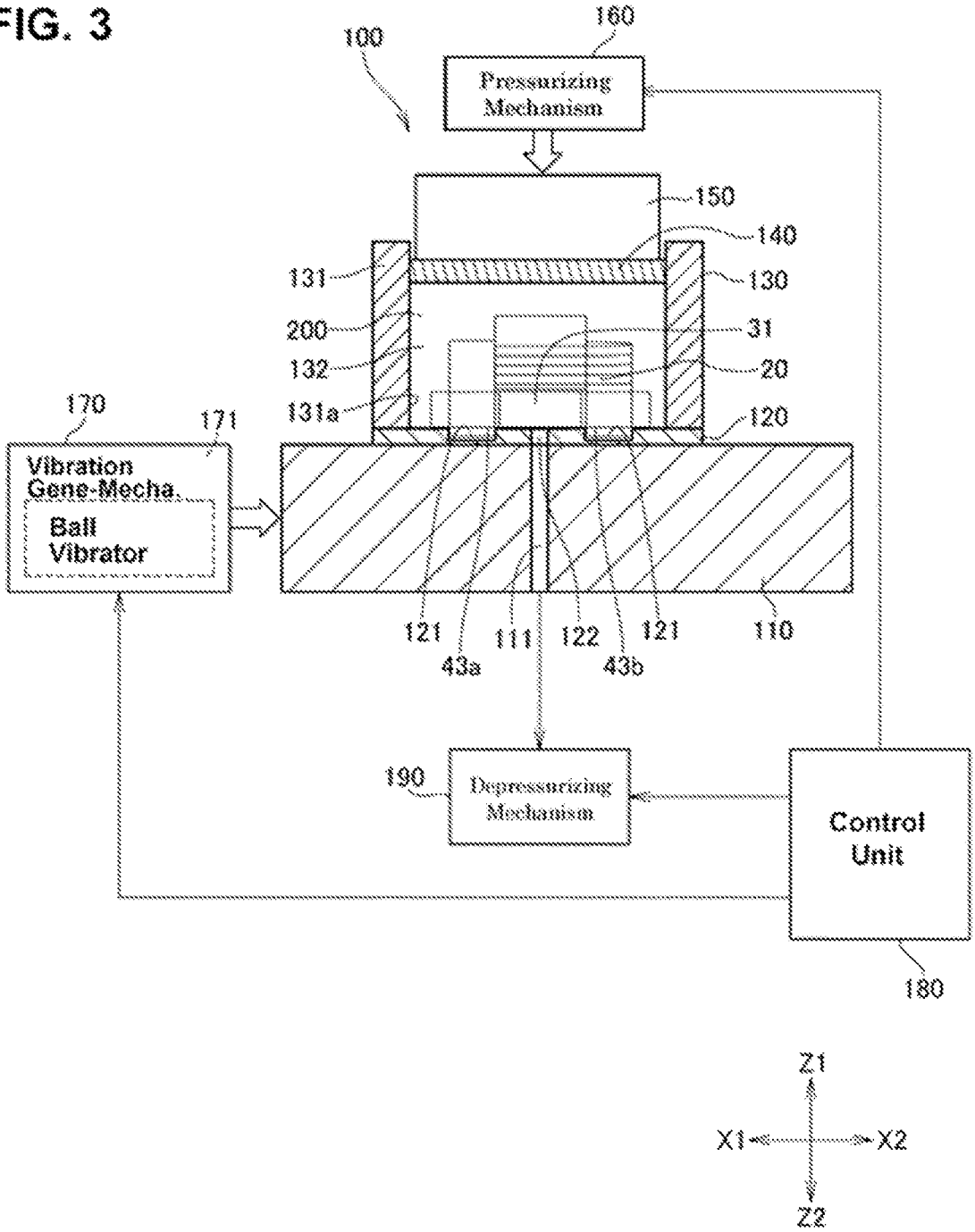
FIG. 3 is a drawing showing a manufacturing apparatus of a coil component according to a first exemplified embodiment of the present invention.

FIG. 3 is a drawing showing a constitution of a manufacturing apparatus 100 used for the manufacturing of the coil component 10. FIG. 3 shows a cross-section of the manufacturing apparatus 100 and within the whole apparatus, hatchings are omitted with regard to a coil-assembly body 20, an admixture 200 and a press member 150 for the sake of convenience. The manufacturing apparatus 100 includes a base plate portion 110, a lower-side support plate 120, a cylindrical die 130, a lid member 140, a press member 150, a pressurizing mechanism 160, a vibration generating mechanism 170 and a control unit 180. Within such a constitution, the die 130 is a container which accommodates the coil-assembly body 20 and the admixture 200 containing magnetic powder and thermosetting resin. The press member 150 applies pressure to the admixture 200 inside the die 130. The vibration generating mechanism applies vibration to the admixture 200 inside the die 130 and the admixture 200 is filled inside the die 130. Further, the manufacturing apparatus 100 of the first exemplified embodiment is provided with a depressurizing mechanism 190 which at least during the application of vibration by the vibration generating mechanism 170, sets an air pressure of the environment in which the admixture 200 is placed to be a negative-pressure lower than the atmospheric pressure. The control unit 180 controls the operation timings and the operation conditions of the pressurizing mechanism 160, the vibration generating mechanism 170 and the depressurizing mechanism 190.

Within the contents mentioned above, according to the present specification, the wording of "filling" indicates that, compared with the state before the vibration-application, the admixture 200 is inputted into the inside of the inner cylindrical portion 132 (see FIG. 3), and it reaches up to every corner of the inner cylindrical portion 132 and the coil-assembly body 20 with fewer air gaps (voids) in it.

Hereinafter, there will be explained such respective constitutions sequentially.

Base-Plate Portion

The base plate portion 110 is a portion which becomes a base of the manufacturing apparatus 100 and is a portion for supporting the lower-side support plate 120 and the die 130. In addition, the base plate portion 110 is a portion which is applied with vibration by the vibration generating mechanism 170 which will be mentioned later. Caused by the application of vibration to such a base plate portion 110, the vibration is applied to the admixture 200 in an inner cylindrical portion 132 of the die 130. It should be noted in the constitution shown in FIG. 3 that there is formed an exhaust hole 111 at the base plate portion 110. This exhaust hole 111 communicates with an insertion hole 122 of the lower-side support plate 120 and it is possible to exhaust air from the inside to the outside of the inner cylindrical portion 132. The exhaust hole 111 is connected with the depressurizing mechanism 190 through an exhaust hose, a valve or the like, which is not shown.

As shown in FIG. 3, in the first exemplified embodiment, it becomes difficult for the admixture 200 to penetrate into the insertion hole 122 caused by a configuration in which the insertion hole 122 is formed at a position facing the lower surface of the flange portion 31. In addition, caused by a configuration in which the insertion hole 122 is arranged on the opposite side of the lid member 140, the whole inside of the inner cylindrical portion 132 is pressurized and it becomes easy for the air within the inner cylindrical portion 132 to be exhausted from the insertion hole 122.

Lower-Side Support Plate

The lower-side support plate 120 is a sheet-shaped or thin plate-shaped member and is a portion for sealing the opening portion on the lower side of the inner cylindrical portion 132 of the die 130. This lower-side support plate 120 is provided with positioning concave-portions 121 which are recessed compared with the upper surface of that lower-side support plate 120 and the terminal units 44*a*, 44*b* of the coil assembly body 20 enter into those positioning concave-portions 121. Thus, the position of the coil assembly body 20 with respect to the inner cylindrical portion 132 of the die 130 will be determined.

In addition, the lower-side support plate 120 is provided with the insertion hole 122 and this insertion hole 122 communicates with the exhaust hole 111 mentioned above. For that reason, in a case of pressing the admixture 200 in the inner cylindrical portion 132 of the die 130, it is possible to exhaust the air which exists in the inner cylindrical portion 132 toward the outside through the exhaust hole 111 and the insertion hole 122.

Die

The die 130 is a member which includes a cylindrical outer cylindrical portion 131 and the portion surrounded by that outer cylindrical portion 131 (portion surrounded by an inner wall 131*a* of the outer cylindrical portion 131) becomes the inner cylindrical portion 132. Then, it is possible to place the coil assembly body 20 in this inner cylindrical portion 132, to fill the admixture 200 therein.

It should be noted that the die 130 is positioned with respect to the lower-side support plate 120 through a positioning member which is not shown. For such a positioning member, it is possible to cite, for example, a configuration in which a protrusion is provided at either one of the lower-side support plate 120 and the die 130 and a concave portion fitting into that protrusion is provided at the other one thereof. Also it is allowed to use another configuration for the positioning member. In addition, it is preferable for the inner wall 131*a* to be coated with a release agent beforehand. In a case of coating the release agent, it is possible, when carrying out an ejecting-step S408 mentioned later, to easily eject an integrated object formed by molding the admixture 200 and the coil assembly body 20 from the inner cylindrical portion 132.

Lid Member

The lid member 140 is a member which is placed so as to cover the admixture 200 from the upward side (Z1 side) of the inner cylindrical portion 132 after the admixture 200 is filled in the inner cylindrical portion 132. It is preferable for this lid member 140 to be formed by a resin material having excellent mold-release characteristics. For one example of such a resin material, it is possible to use a fluorine resin material such as polytetrafluoroethylene (PTFE) or the like. It should be noted that there is no limitation for the thickness of the lid member 140 in particular, in which it is allowed to employ a member having a so-called sheet shape and other than this shape, a plate shape, a block shape or the like. In addition, the lid member 140 is provided to be approximately the same as the shape of the inner cylindrical portion 132 when planarly viewed and it is possible to press the admixture 200 which is filled in the inner cylindrical portion 132 excellently while preventing the admixture 200 from leaking from the gap between the lid member 140 and the inner wall 131*a* of the outer cylindrical portion 131.

Press Member

The press member 150 is a member for pressing the lid member 140 from the upward side thereof and is provided to have a smaller diameter than that of the lid member 140. For that reason, it is possible to prevent the press member 150 from colliding with the outer cylindrical portion 131. In addition, it is preferable for the press member 150 to be provided to have a larger thickness than that of the lid member 140. It is possible for the press member 150 to use, for example, a block-shaped member. However, the press member 150 is not to be limited to the block-shaped member and it is allowed to use, for example, an arm or the like which presses the lid member 140 toward one direction.

Pressurizing Mechanism

The pressurizing mechanism 160 is a mechanism for applying a pressing force onto the press member 150 from the upward side of the press member 150. Owing to such a pressurizing mechanism 160, it becomes possible to pressurize the admixture 200 which exists in the inner cylindrical portion 132. It should be noted that it is allowed to employ a pressurizing mechanism 160 which applies a predetermined pressing force continuously and it is also allowed to employ a pressurizing mechanism which applies a predetermined pressing force periodically.

For the pressurizing mechanism 160 of the first exemplified embodiment, it is supposed that the pressure is to be applied with respect to an area of from 1 $mm^2$ to 30 $mm^2$ per one product, in which it is preferred to apply a pressure of 0.01 MPa or more and 20 MPa or less onto such an area. Further, it is more preferable to apply a pressure of 0.5 MPa or more and 2 MPa or less.

Vibration Generating Mechanism

The vibration generating mechanism 170 is a mechanism which is attached to the base plate portion 110 and is a mechanism for applying a vibration with respect to that base plate portion 110. The vibration generating mechanism 170 corresponds to the vibration applying member. It is possible for the vibration generating mechanism 170 to employ, for example, a mechanism using a ball vibrator 171 and a compressor (not shown). The ball vibrator 171 is provided with an iron-steel-made iron ball and a cylindrical case for rotating the iron ball in which there is supplied a compressed air into the inside of the cylindrical case from a compressor. The iron ball rotates high-speedily caused by the pressure of the compressed air which is supplied into the inside of the cylindrical case, and caused by that action, the vibration is applied to the base plate portion 110.

The vibration applied to the base plate portion 110 is applied to the lower-side support plate 120, the die 130 and the admixture 200. The admixture 200 vibrates by the applied vibration and the molding-degree thereof becomes high. Here, the wording "molding-degree" expresses "degree of easily-molded" in which the material deforms and becomes another shape, wherein the state that the molding-degree is high indicates a state in which it is easy for that material to become a predetermined shape under a certain condition and the state that the molding-degree is low indicates a state in which it is difficult for that material to become a predetermined shape even under a similar condition. The molding-degree of the admixture 200 has a correlation with the applied vibration-frequency. The inventor etc. of the present invention found out a range of the vibration frequency which largely improves the molding-degree of the admixture 200 and by using this frequency, the vibration is applied to the base-plate portion 110. The vibration which is preferable to be applied to the base-plate portion 110 of the first exemplified embodiment has a frequency of, for example, 130 Hz or more and 190 Hz or less. It should be noted that it is allowed that the vibration applied to the admixture 200 of the first exemplified embodiment is to be formed by vibrating the base-plate portion 110 toward a vertical direction or to be formed by the vibration toward a horizontal direction. In other words, it is allowed for the direction of the vibration to be a perpendicular direction with respect to the pressurizing direction of the pressurizing mechanism 160 and it is also allowed to be the same direction therewith.

By the fact that the molding-degree is heightened, the admixture 200 enters into every corner of the inner cylindrical portion 132 and into air gaps of the coil-assembly body 20, into which the admixture 200 did not enter before the vibration-application. In addition, there exists no air gap or the like in the admixture 200 thereof.

Here, there is employed a mechanism for the ball vibrator 171 in which the iron ball does not move in a linear direction one-dimensionally but rotates, as mentioned above, in a circle orbit in the cylindrical case. For that reason, the base plate portion 110 is applied with a vibration which is not linear but planar (two-dimensional) caused by the ball vibrator 171. Therefore, the admixture 200 can be filled into the air gap more excellently. It should be noted that it is allowed for the rotational surface formed by the rotation of the iron ball to be set in parallel with the XY plane. Also it is allowed to let the rotational surface, to be in parallel with the Z direction like what XZ plane or ZX plane is. In addition, it is also allowed for the ball vibrator to be mounted so as to be inclined with respect to the XY plane, the YZ plane or the ZX plane with a predetermined angle. Furthermore, there is no limitation of the mounting method thereof. Among those methods above, when vibrating the base-plate portion 110 toward the perpendicular direction with respect to the pressurizing direction of the pressurizing mechanism 160, it is possible to vibrate the admixture 200 by the vibration generating mechanism 170 preferably while maintaining the pressurizing state made by the pressurizing mechanism 160.

It should be noted that the vibration generating mechanism 170 is not to be limited to a mechanism which uses the ball vibrator 171. For example, it is allowed for the vibration generating mechanism 170 to use a driving device of such a type in which the vibration is generated by mounting a rotational body onto a motor in an eccentric state and by rotating that rotational body. Besides, it is possible for the vibration generating mechanism 170 to use various types of driving devices such as driving devices of ultrasonic methods, driving devices of such types using electromagnets and the like.

Depressurizing Mechanism

The depressurizing mechanism 190 includes a vacuum pump communicating with the exhaust hole 111 which communicates with the inner cylindrical portion 132. It is allowed for the vacuum pump to have any constitution if only the inside of the inner cylindrical portion 132 can be made to have a necessary degree of vacuum for filling the admixture 200. For the first exemplified embodiment, it is assumed that the depressurizing mechanism 190 has such an ability that it is possible to make the air pressure inside the inner cylindrical portion 132 to be from a pressure less than the atmospheric pressure to the atmospheric pressure. And specifically, it is assumed that there can be achieved a degree of vacuum from $10^{-2}$ Pa or more until $10^{5}$ Pa or less. For a vacuum pump which can achieve such a degree of vacuum, there exist, for example, a rotary pump, a diaphragm pump and the like. In addition, it is also allowed for the depressurizing mechanism 190 to include a vacuum meter or the like which monitors the degree of vacuum in the inner cylindrical portion 132.

Control Unit

The control unit 180 has a constitution for controlling the operations of the pressurizing mechanism 160, the vibration generating mechanism 170 and the depressurizing mechanism 190. Here, the wording of "the operation of the pressurizing mechanism 160" indicates "the start of pressurizing", "the end timing", "applying the pressure to the lid member 140", and the like. In addition, the wording of "the operation of the vibration generating mechanism 170" indicates "the start of vibration-application", "the end timing", "the vibration frequency", and "the direction" thereof. Further, the wording of "the operation of the depressurizing mechanism 190" indicates "the start of depressurizing", "the end timing", "controlling the air pressure inside the inner cylindrical portion 132", and the like. For the control unit 180 of the first exemplified embodiment, it is allowed to employ a configuration of controlling each of the mechanisms automatically in accordance with a preset condition. And it is also allowed to employ a configuration in which an operator inputs or manually carries out at least a part of the operation. Such a control unit 180 can be realized also by using a general-purpose computer, a dedicated microcomputer or the like.

Manufacturing Method of Coil Component

Next, there will be explained a manufacturing method of a coil component, which is carried out by a manufacturing apparatus of a coil component as explained above.

Figure 4:
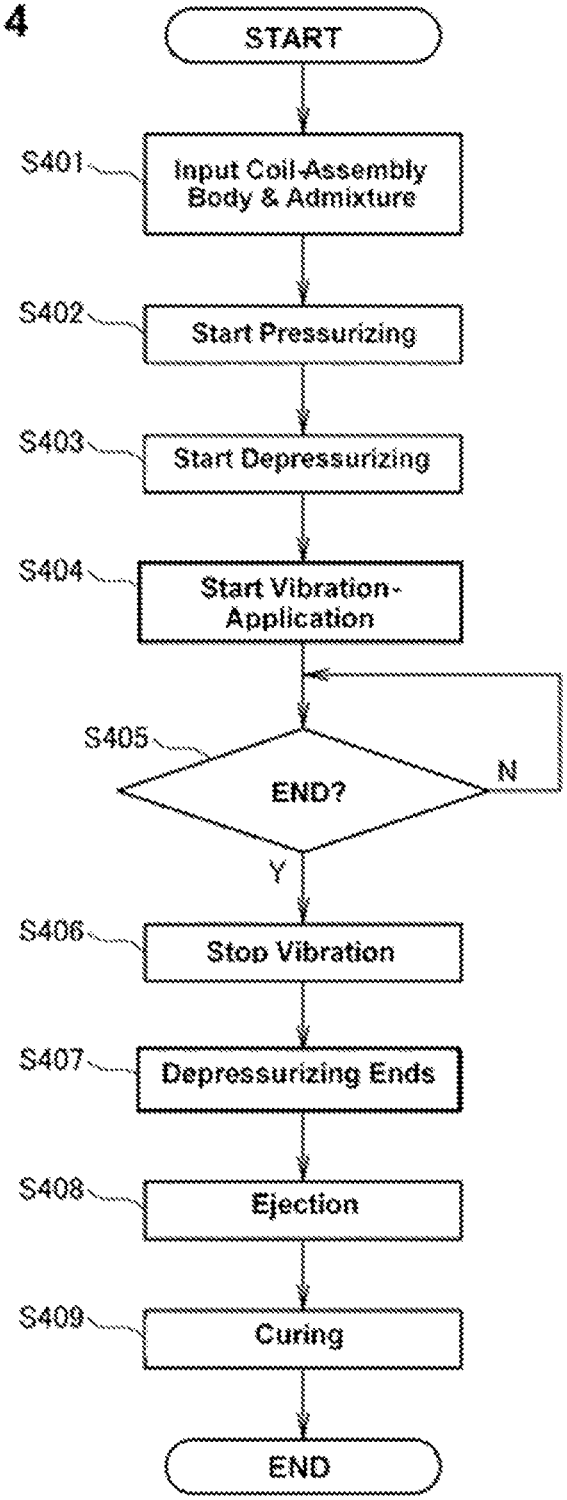
FIG. 4 is a flowchart showing a manufacturing method of a coil component according to the first exemplified embodiment of the present invention.

FIG. 4 is a flowchart showing a manufacturing method of a coil component according to the first exemplified embodiment. The coil manufacturing method of the first exemplified embodiment is a manufacturing method of a coil component for forming a coil-assembly body 20 in which a coil is mounted on a magnetic-body core 30. As shown in FIG. 4, in the coil manufacturing method of the first exemplified embodiment, there exist the coil-assembly body 20; an input step (S401) for inputting the admixture 200 which includes the magnetic powder and the resin into the inner cylindrical portion 132 which is a container; a pressurizing step (S402) for applying pressure onto the admixture 200 which is inputted into the inner cylindrical portion 132, a depressurizing step (S403) for depressurizing an air pressure of the environment, in which the admixture 200 is placed, to become a negative-pressure lower than the atmospheric pressure at least during the pressurizing process in the pressurizing step (S402); a vibration-application step (S404) for applying vibration onto the admixture 200 and filling the admixture 200 in the inner cylindrical portion 132 at least during the depressurizing process in the depressurizing step (S403); and a curing step (S408) for curing the resin, which is contained in the admixture 200, for the integrated object of the admixture and the coil-assembly body 20, which passed through the depressurizing step S403 and the vibration-application step S404. Here, the wording of "at least during the pressurizing process in the pressurizing step" expresses that the depressurizing step S403 may start before the start of the pressurizing step 402 or may start after the start thereof. In addition, the wording of "at least during the depressurizing process in the depressurizing step" expresses that the vibration-application step S404 may start before the start of the depressurizing step S403 or may start after the start thereof. It should be noted in the first exemplified embodiment that the explanation will be carried out by citing an example in which a thermosetting resin is used for the step S408. For this reason, in the abovementioned steps, all the steps other than the curing step S408 are carried out under the room temperature. However, as described above, the first exemplified embodiment is not to be limited to using a thermosetting resin and it is also allowed to use a two-component curing-type resin or a light-curing resin.

Hereinafter, there will be explained the abovementioned respective steps.

Input Step

In the input step S401 of the first exemplified embodiment, the coil assembly body 20 is placed on the lower-side support plate 120 in the inner cylindrical portion 132, and the admixture 200 is inputted into the inside of the inner cylindrical portion 132. At that time, caused by a configuration in which the terminal units 44*a*, 44*b* are made to enter into positioning concave-portions of the lower-side support plate 120, which are not shown, the coil assembly body 20 is positioned in the inner cylindrical portion 132.

The admixture 200 of the first exemplified embodiment is a putty-like admixture (in other words, clay-like admixture) obtained by mixing metal-made magnetic powders and a resin and by adding a solvent thereto. For that reason, for example, in a case of forming the admixture 200 to have a certain shape, the molding-degree thereof becomes an identical or similar viscosity as that of the clay and the shape thereof can be maintained. It should be noted that the magnetic cover portion 50 is formed by the admixture 200 and therefore, the magnetic powders and the resin are made by the same materials as those of the above-mentioned magnetic cover portion 50. In addition, it is possible for the solvent to arbitrarily utilize a well-known organic solvent such as acetone, MEK (methyl ethyl ketone), ethanol, α-Terpineol, IPA (isopropyl alcohol) or the like.

As an example of the admixture 200, there can be cited an admixture obtained by mixing the metal magnetic powders and the epoxy resin under a condition in which the composition ratio there-between is selected as 90:10 to 99:1 (including both of the end-values) by mass-ratio. Further, it is possible to prepare the viscosity of the admixture 200 by adding the solvent selectively. For one example of the metal magnetic powders, it is possible to cite powders in which amorphous metal magnetic powders containing at least iron, silicon, chromium and carbon are mixed with iron-silicon chromium based alloy powders by mass-ratio 1:1.

In addition, it is possible to use a terpineol for the solvent which is added to the admixture 200 in which the additive amount of the solvent is made to be less than 5 wt % with respect to the mass of the admixture 200. Thus, it is possible to set the admixture 200 in a putty state having comparatively high viscosity. At that time, the viscosity of the admixture 200 becomes within a range of 30 Pa·s to 3000 Pa·s.

In addition, in a case of inputting the admixture 20 into the cylindrical portion 132, the block body of the admixture 200 is formed beforehand so as to obtain a proper amount of the admixture 200 and, in addition, so as to form a shape which is easily inputted to the inner cylindrical portion 132. Then, after placing the coil assembly body 20 on the lower-side support plate 120, the block body of the admixture 200 is placed on the upper portion of the coil assembly body 20.

Pressurizing Step

Next, in the first exemplified embodiment, the pressurizing step S402 is carried out. In the pressurizing step S402, the lid member 140 is placed on the upper portion of the admixture 200 and after placing the press member 150 on the upper portion of the lid member 140, the pressurizing mechanism 160 is activated. Thus, the lid member 140 is pressed by the pressurizing mechanism 160 toward the Z2 direction shown in FIG. 3 and the pressurizing mechanism 160 applies pressure onto the admixture 200. The pressurized admixture 200 enters into the air gap inside the inner cylindrical portion 132 and is to be filled into the inside of the inner cylindrical portion 132. Such a pressurizing step S402 of this exemplified embodiment is a step in which the inner cylindrical portion 132 is filled with the admixture 200 without substantially changing the volume of the admixture 200 eliminating the air gap thereof. For this reason, the pressurizing step S402 is designed to be different from a well-known compression-step in which the processed-object such as ferrite, iron powder or the like is compressed by high pressure and the volume thereof is reduced significantly. While a high pressing force of around 0.5 tons/cm2 to a few tons/cm2 is generally loaded onto the processed-object in the well-known compression-step, it is enough in the pressurizing step S402 of the first exemplified embodiment if a pressing pressure of, for example, around 0.5 kg/cm2 to 50 kg/cm2 is to be loaded onto the admixture 200. Therefore, in the pressurizing step S402, also the damage to the die 130 becomes less compared with the well-known compression step and there can be obtained such a merit that the selective range of the material for the die 130 will be widened. In the pressurizing step S402, the position of the press member 150 is maintained also during the succeeding step of depressurizing or the like and the pressure is kept on being applied to the admixture 200.

Depressurizing Step

Next, in the first exemplified embodiment, the depressurizing step S403 is carried out. In the depressurizing step, there is maintained the state in which the pressurizing mechanism 160 pressurized the press member 150 and the lid member 140. It means that the maintenance of this pressurizing state is one part of the pressurizing step S402 and that it is also a part of the vibration-application step S404. In this manner, the control unit 180 activates the depressurizing mechanism 190 while the admixture 200 is pressurized. The depressurizing mechanism 190 sets the air pressure inside the inner cylindrical portion 132 to be, for example, 100 Pa or more and 104 Pa or less. The air pressure inside the inner cylindrical portion 132 is determined according to the balance between the exhaust ability of the depressurizing mechanism 190 and the flow-rate (air tightness in the inner cylindrical portion 132) of the atmospheric air which flows into the inside of the inner cylindrical portion 132.

Vibration-Application Step

The vibration-application step S404 of the first exemplified embodiment is a step for applying vibration to the admixture 200. In the vibration-application step S404, the control unit 180 controls the vibration generating mechanism 170 and the application of the vibration with respect to the admixture 200 is started. At that time, in the inner cylindrical portion 132, the admixture 200 is pressurized and the internal pressure therein becomes a depressurized state. At that time, the vibration is applied to the base-plate portion 110 and the applied vibration is also transmitted to the admixture 200.

With regard to the vibration applied by the vibration generating mechanism 170, the amplitude thereof is designed to be within a range of 0.1 μm to 1 cm. In addition, the frequency of the applied vibration is designed to be within a range of 2 Hz to 500 Hz. Within such a range, it is preferable, for the first exemplified embodiment, to apply a vibration, whose frequency is particularly 130 Hz or more and 190 Hz or less, to the admixture 200.

In addition, in the first exemplified embodiment, the time period for applying the vibration by the vibration generating mechanism 170 is designed to be within a range of 1 second to 300 seconds. It should be noted that the time period for applying the vibration is not to be limited to the above-mentioned range and it is allowed to vibrate the admixture 200, for example, for more than 100 seconds.

By applying the vibration to the admixture 200, the molding-degree thereof becomes high rapidly. For that reason, when the molding-degree of the admixture 200 became high rapidly, by pressurizing the admixture 200 in one direction under the condition mentioned above. And by depressurizing the ambient pressure, the admixture 200 enters into the air gaps sufficiently in the inner cylindrical portion 132 and is filled in the inner cylindrical portion 132 fully. In addition, by pressurizing the admixture 200 and placing it under a depressurizing environment, the air gaps occurring in the admixture 200 are crushed and will disappear. Caused by such a phenomenon, it happens that in the first exemplified embodiment, the admixture 200 will cover the whole circumference of the coil-assembly body 20 without any air gaps and it is possible to eliminate the filling defect.

After starting the pressurizing step S402, the depressurizing step S403 and the vibration-application step S404, in the first exemplified embodiment, the control unit 180 judges the end timings of those respective steps (S405). It is allowed to judge the end timing of each step, for example, by a predetermined time-lapse from the start of the each step. In addition, it is allowed to employ a configuration for the respective end timings of the steps in which the vibration-stopping step S406 and the depressurizing step S407 sequentially in this order. However, the depressurizing step S403, the vibration-application step S404, the vibration-stopping step S406 and the depressurizing step S407 are not limited to a configuration of being carried out by the sequential order shown in the flow chart of FIG. 4. For example, it is allowed to start the depressurizing step S403 and the vibration-application step S404 to simultaneously and it is also allowed to carry out the vibration-application step S404 preceding to the depressurizing step S403. In addition, if the lid member 140 is a member closable when applying the pressure to the admixture 200, it is allowed to carry out the pressurizing step S402 simultaneously in addition to the depressurizing step S403 and the vibration-application step S404.

Further, it is allowed to carry out the vibration-stopping step S406 and the depressurizing step S407 simultaneously and it is also allowed to carry out the depressurizing step S407 preceding to the vibration-stopping step S406.

Ejecting-Step

Next, in the first exemplified embodiment, the ejecting-step S408 is carried out. In the ejecting-step S408, the pressurization of the admixture 200 is released by a configuration in which the control unit 180 controls the pressurizing mechanism 160 and the press member 150 is pressed-up toward the Z1 direction shown in FIG. 3. After the release of the pressurization, the integrated object of the admixture 200 and the coil-assembly body 20 is ejected from the inside of the inner cylindrical portion 132. At that time, the top surface portion of the admixture 200 is in close contact with the lid member 140 and therefore, it is possible to eject the integrated object when the upper surface is in close contact with the lid member 140 by pushing the integrated object upward, for example, by inserting a pin shaped push-up member into the lower surface of the integrated body in the inner cylindrical portion 132.

Curing Step

Next, in the first exemplified embodiment, the curing step S409 is carried out. In the curing step S409, the admixture 200 in the ejected integrated object is thermally-cured by being heated up to the thermosetting temperature or more. At that time, the solvent contained in the admixture 200 is removed by being volatilized. Then, after a state in which the admixture 200 is cured sufficiently and becomes a magnetic cover portion 50, the lid member 140 is removed from the upper surface of the integrated object. Thus, the coil component 10 is formed.

It should be noted with regard to the ejecting-step S408 and the curing step S409 that it is not to be limited to carrying out such a procedure as mentioned above. More specifically, it is allowed, before carrying out the ejecting-step S408, to carry out the curing step S409 when the integrated object is filled in the inner cylindrical portion 132. Then, it is allowed, after curing the integrated object completely in the curing step S409, to carry out the ejecting-step S408.

In addition, in the first exemplified embodiment, the curing step S409 of the first stage is carried out by a first temperature before carrying out the ejecting-step S408, in which the admixture 200 of the integrated object is to be semi-cured. At that time, while the first temperature is selected to be less than the thermosetting temperature of the thermosetting resin, the first temperature is made to be a temperature by which the solvent contained in the admixture 200 is volatilized so as to semi-cure the integrated object. Thereafter, the ejecting-step S408 is carried out and the integrated object containing the semi-cured admixture 200 is ejected from the inner cylindrical portion 132. Then, the curing step S409 of the second stage is carried out at a second temperature which is higher than the first temperature. At that time, the second temperature made to be equal to or higher than the thermal-cure temperature of the thermosetting resin. It should be noted that it is allowed for the first temperature to be equal to or higher than a curing start temperature of the thermosetting resin and also lower than a complete curing temperature.

In addition, it is allowed to carry out a post-treatment step after carrying out the curing step S409. For the post-treatment step, there can be cited such as a polishing step of the surface of the magnetic cover portion 50, a coating-formation step by using a thermosetting resin or the like, and the like.

According to the first exemplified embodiment as explained above, it is possible to prevent the air gaps which are not filled with the admixture 200 from being formed in the inner cylindrical portion 132 of the die 130. More specifically, the putty-like admixture 200 has a high viscosity and even if the admixture 200 inputted into the inner cylindrical portion 132 is pressurized, there is a fear that a place which is not sufficiently filled with the admixture 200 (filling defect) is caused in the inner cylindrical portion 132.

However, in the first exemplified embodiment, after the admixture 200 is inputted into the inner cylindrical portion 132 in the pressurizing step S402, the depressurizing step S403 is carried out and the admixture 200 is pressed onto the inner wall of the inner cylindrical portion 132, and concurrently, the vibration-application step S404 is carried out and the molding-degree of the admixture 200 is heightened. It should be noted that as mentioned before, the wording "molding-degree" expresses "degree of easily-molded" in which the material deforms and becomes another shape and therefore, the admixture 200, whose molding-degree is heightened, deforms in conformity with the shapes of the inner cylindrical portion 132 and the coil-assembly body 20 and it becomes easy for the admixture to enter into the air gaps of the inner cylindrical portion 132 and the air gaps of the coil-assembly body 20. Therefore, in the first exemplified embodiment, it is possible to prevent the places which are not filled with the admixture 200 (filling defect) from occurring in the inner cylindrical portion 132. In such a first exemplified embodiment, it is possible to uniformize the quality of the coil component 10 which is formed by way of the subsequent ejecting-step S408, curing step S409 and the like.

Second Exemplified Embodiment

Next, there will be explained a second exemplified embodiment of the present invention.

Figure 5:
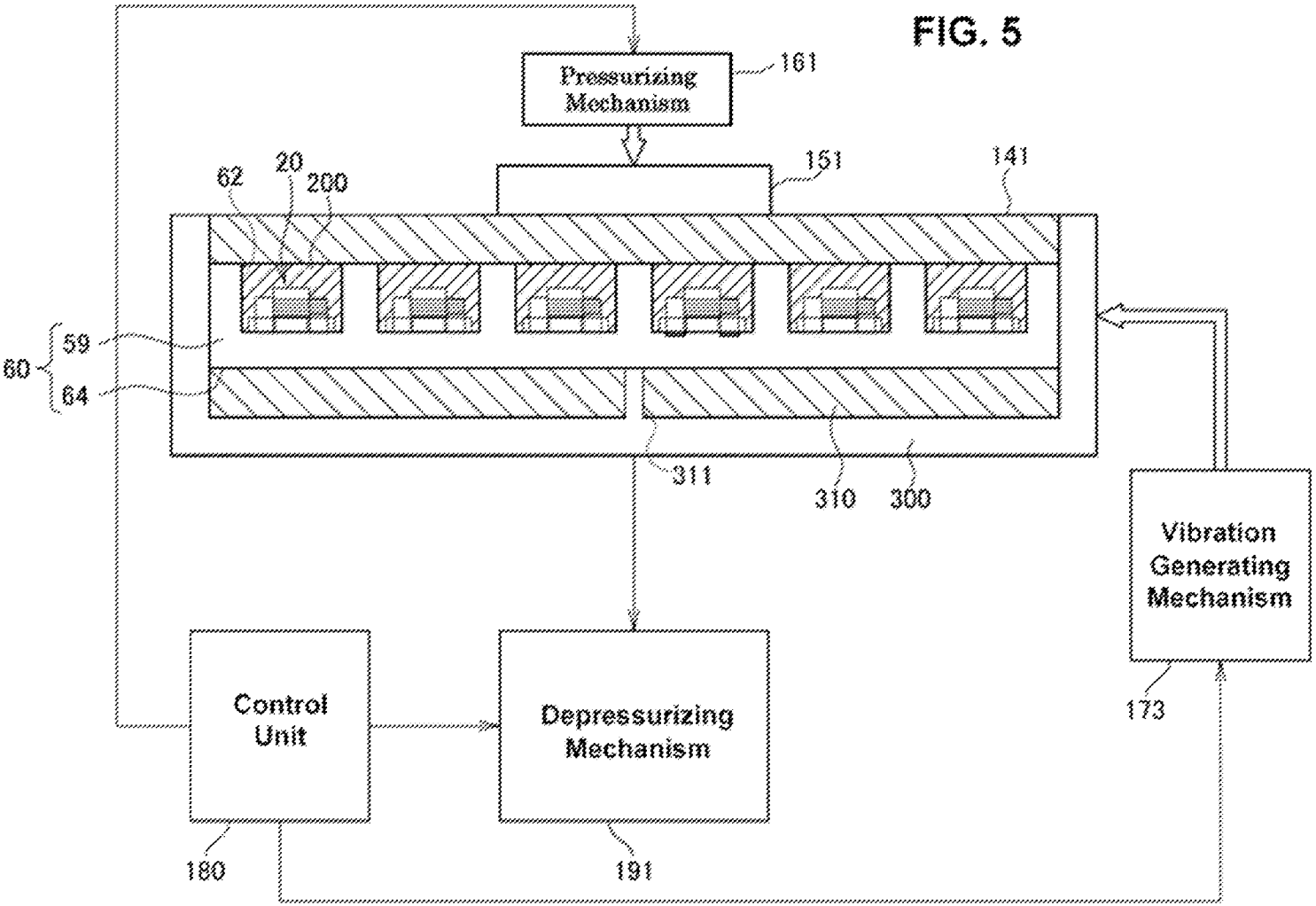
FIG. 5 is a drawing showing a manufacturing method of a coil component according to a second exemplified embodiment of the present invention.

FIG. 5 is a drawing for explaining a manufacturing method of a coil component according to a second exemplified embodiment of the present invention. In the second exemplified embodiment, with regard to similar constitutions as the constitutions which were explained in the first exemplified embodiment, similar reference numerals are applied thereto and the explanations and illustrations thereof will be omitted.

The manufacturing method of the coil component in the second exemplified embodiment is a method having a configuration, for the depressurizing step S403 in the first exemplified embodiment, in which a mold body 60, which includes cavity portions 62 corresponding to a plurality of containers, is depressurized at once in a depressurizing chamber 300 which can accommodate the plurality of containers. In order to realize such a manufacturing method of a coil component, the manufacturing apparatus (400) of a coil component in the second exemplified embodiment includes a mold body 60 provided with a plurality of cavity portions 62; a base-plate portion 310 which supports the mold body 60; a lid member 141 which pressurizes the admixture 200 inputted into the mold body 60; a press member 151; and a pressurizing mechanism 161. The mold body 60, the base-plate portion 310 and the lid member 141 are housed in the depressurizing chamber 300.

Further, for the manufacturing apparatus 400 of the second exemplified embodiment, an exhaust hole 311 is formed at the base-plate portion 310 and there is included a depressurizing mechanism 191 which depressurizes the inside of the depressurizing chamber 300 through the exhaust hole 311. Further, the manufacturing apparatus 400 includes a vibration generating mechanism 173 which applies a vibration to the admixture 200 through the base-plate portion 310, a pressurizing mechanism 161 and a control unit 180 which controls the operations of the depressurizing mechanism 191 and the vibration generating mechanism 173. It should be noted that although the illustration is omitted, exhaust paths which communicate with the respective cavity portions 62 and the exhaust hole 311 are formed in the mold body 60 and when the depressurizing mechanism 191 starts the exhausting, the air is exhausted, by the depressurizing mechanism 191, from the inside of the cavity portion 62 by passing through the exhaust hole 311.

The mold body 60 is formed by a resin material having a good mold-releasing property. For the resin material of the mold body 60, it is possible to cite a silicone rubber material as an example. As shown in FIG. 5, the mold body 60 has a constitution in which an integrated jig 59 and a bottom portion 64 are formed integrally. The mold body 60 has flexibility and also is provided with a plurality of arranged cavity portions 62. In the input step S401 shown in FIG. 4, each of the plurality of cavity portions 62 is inputted with the admixture 200 and the coil-assembly body 20. Specifically, the coil-assembly body 20 is inputted into the cavity portion 62 and the coil-assembly body 20 is fixed by being fitted with a concave portion (not-shown) which is provided at the bottom surface of the cavity portion 62. Then, the admixture 200 is inputted into the cavity portion 62.

Next, in the second exemplified embodiment, the mold body 60 is attached with the lid member 141 and the press member 151 is placed on the lid member 141. The control unit 180 pressurizes the admixture 200 by the pressurizing mechanism 161 and subsequently, the inside of the depressurizing chamber 300 is depressurized by the depressurizing mechanism 191, and the vibration is applied to the admixture 200 through the base-plate portion 310 by controlling the vibration generating mechanism 173. According to the operations mentioned above, it is possible for the second exemplified embodiment to manufacture integrated objects formed by the plurality of coil-assembly bodies 20 and the admixtures 200 simultaneously in the plurality of cavity portions 62.

It should be noted in the second exemplified embodiment that the explanation thereof will be carried out by citing an example of using a thermosetting resin for the resin similarly as that of the first exemplified embodiment. However, the second exemplified embodiment is not to be limited either by using the thermosetting resin for the resin and it is also allowed for the resin to use a two-component curing-type resin or a light-curing resin. In the second exemplified embodiment, the plurality of coil components 10 (see FIG. 1, FIG. 2) are molded by thermally-curing the admixtures 200 respectively in the mold body 60 and then, it is good choice if the plurality of molded coil components 10 are taken out from the cavity portions 62 by bending the mold body 60 in a way of a reverse-bending toward the arrangement direction of the cavity portions 62.

INVENTIVE EXAMPLE

Next, there will be explained an inventive example for the first exemplified embodiment and the second exemplified embodiment which were explained above. This inventive example is an example presenting the result obtained by an experiment with regard to a mater that the molding-degree of the admixture 200 will become high by applying the vibration while pressurizing the admixture 200.

Figure 6:
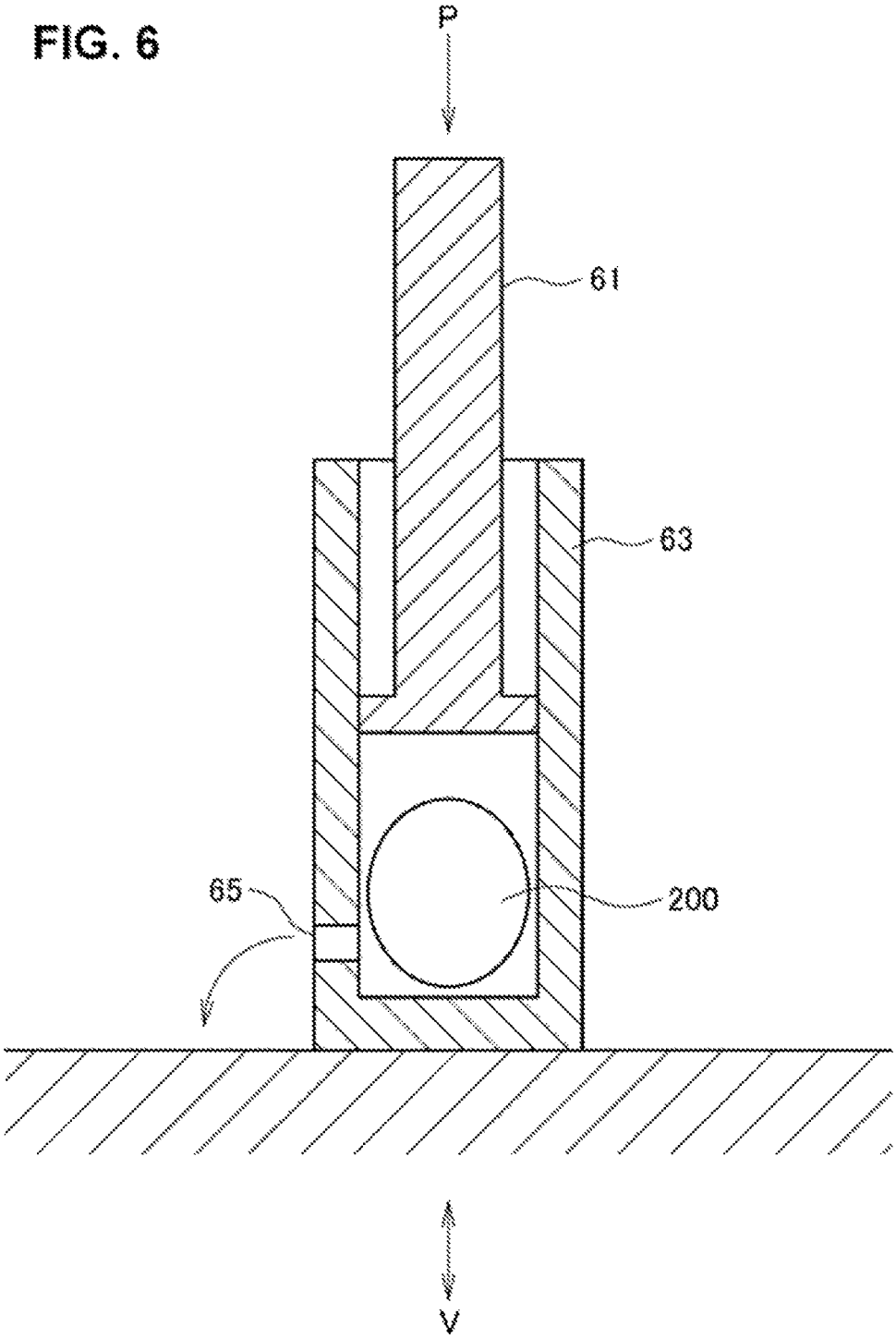
FIG. 6 is a drawing for explaining an inventive example of the present invention.

FIG. 6 is a drawing for explaining an apparatus which was used for the experiment of this inventive example. The apparatus shown in FIG. 6 includes a cylinder 63 and a pressurizing pin 61 which pressurizes the admixture 200 in the cylinder 63. In this inventive example, with respect to the admixture 200 in the cylinder 63, there is applied a vibration V whose frequency changes continuously is applied from the lower side in FIG. 5 while there is applied a pressure by the pressurizing pin 61. The cylinder 63 is formed with a discharge port 65 and the admixture 200 applied with the pressure and the vibration is discharged from the discharge port 65 to the outside of the cylinder 63. The discharge amount of the admixture 200 changes depending on the molding-degree of the admixture 200 and it is conceivable that the lower the molding-degree is the greater the discharge amount becomes.

It should be noted in this inventive example that the inner diameter of the discharge port 65 was made to be 2.0 mm. In addition, the frequency range of the vibration V was made to be from 70 Hz to 210 Hz.

With regard to this inventive example, the pressurizing pin 61 applies a pressure of 0.5 MPa or more and 2 MPa or less with respect to the admixture 200. The viscosity of the admixture 200 is in a range of 107 cPs or more and 1012 cPs or less, more preferably, in a range of 3×1010 cPs or more and 1011 cPs or less. In addition, in a case of defining the viscosity-range of the admixture 200 by making the resin content as an index, the range of the resin content is from 5 Vol % or more to 80 Vol % or less. Further, in this inventive example, the pressure and the vibration V are applied to the admixture 200 for 60 seconds.

Figure 7:
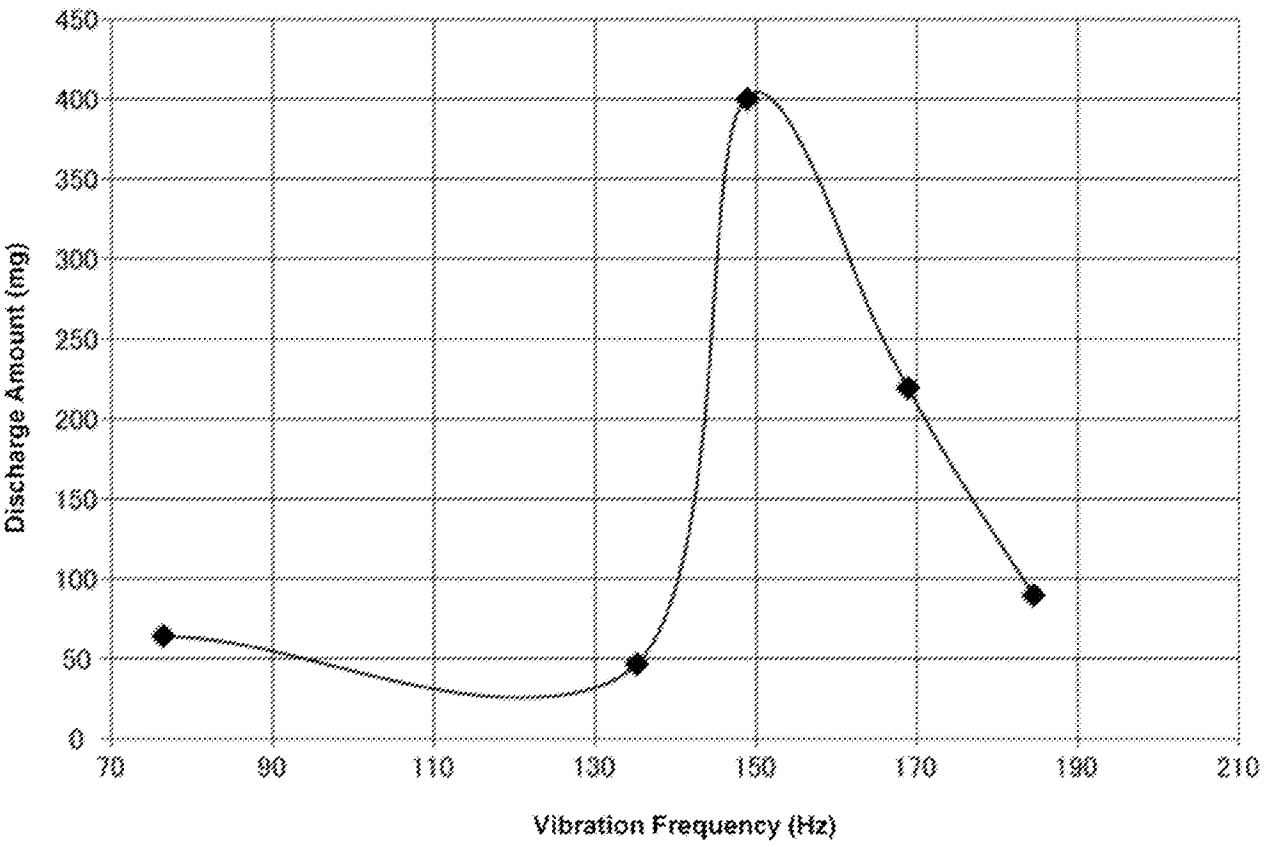
FIG. 7 is a graph for explaining the result of the inventive example shown in FIG. 6.

FIG. 7 is a graph presenting the result obtained by an experiment that was carried out by using the apparatus shown in FIG. 6. The horizontal axis of the graph shown in FIG. 6 indicates the frequency (vibration number) of the vibration V which was applied to the admixture 200, and the vertical axis thereof indicates the amount of the admixture 200 which was discharged from the discharge port 65 during the application of the pressure and the vibration V. As shown in FIG. 7, the discharge amount of the admixture 200 ascends with a steep inclination from around a frequency exceeding 130 Hz and reaches a peak at 150 Hz. The discharge amount descends comparatively steeply after exceeding the frequency 150 Hz of the vibration V. According to FIG. 7, it is understood, in this inventive example, that it is possible to heighten the molding-degree of the admixture 200 efficiently by applying a frequency of 140 Hz or more and 190 Hz or less onto the admixture 200.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A manufacturing method of a coil component, the manufacturing method comprising:

preparing a coil-assembly body in which a coil is mounted on a magnetic-body core;

inserting the coil-assembly body and an admixture containing a magnetic powder and a resin into a container, the container having an air path fluidly connecting an inside of the container and an outside of the container;

applying a pressure onto the admixture in the container;

depressurizing the inside of the container while the coil-assembly body and the admixture are in the container and during the applying of the pressure onto the admixture, the inside of the container being at a negative-pressure lower than an atmospheric pressure by vacuuming via the air path of the container;

applying a vibration to the admixture and spreading the admixture in the inside of the container during the depressurizing; and curing the resin contained in the admixture to form the coil component integrated with the admixture and the coil-assembly body after the depressurizing and the applying of the vibration are stopped.

2. The manufacturing method of the coil component according to claim 1, further comprising:

preparing a plurality of the coil-assembly bodies;

inserting the plurality of the coil-assembly bodies and the admixtures into a plurality of the containers, respectively; and placing the plurality of the containers in a depressurizing room after the inserting of the plurality of the coil-assembly bodies and the admixtures, wherein in the depressurizing, the insides of the plurality of the containers are depressurized simultaneously in the depressurizing room.

3. The manufacturing method of the coil component according to claim 1, wherein the applying of the vibration heightens a molding-degree of the admixture in the container due to the vibration.

4. The manufacturing method of the coil component according to claim 1, wherein in the applying of the vibration, a frequency of 130 Hz or more and 190 Hz or less is applied to the admixture as the vibration.

5. The manufacturing method of the coil component according to claim 1, wherein the depressurizing starts after the applying of the pressure starts, and the applying of the vibration starts after the depressurizing starts.

6. The manufacturing method of the coil component according to claim 1, wherein the inserting of the coil-assembly body and the admixture, the applying of the pressure, the depressurizing, and the applying of the vibration are carried out under a room temperature.

7. The manufacturing method of the coil component according to claim 1, wherein the negative-pressure is in a range of $10^{-2}$ Pa to $10^{5}$ Pa.

8. A manufacturing apparatus comprising:

a container housing a coil-assembly body and an admixture containing a magnetic powder and a resin, the container having an air path fluidly connecting an inside of the container and an outside of the container;

a press member applying a pressure to the admixture located in the inside of the container;

a vibration generating mechanism which applies a vibration to the admixture in the container to spread the admixture in the container; and a depressurizing mechanism depressurizing the inside of the container while the coil-assembly body and the admixture are in the container and the pressure is applied to the admixture, the inside of the container being at a negative-pressure lower than an atmospheric pressure by vacuuming via the air path of the container.

9. The manufacturing apparatus according to claim 8, wherein the negative-pressure is in a range of $10^{-2}$ Pa to $10^{5}$ Pa.

* * * * *